US005889541A

United States Patent [19]

Bobrow et al.

[11] Patent Number: 5,889,541

[45] Date of Patent: Mar. 30, 1999

[54] TWO-DIMENSIONAL PRINT CELL ARRAY APPARATUS AND METHOD FOR DELIVERY OF TONER FOR PRINTING IMAGES

[75] Inventors: Daniel G. Bobrow, Palo Alto, Calif.; Scott Elrod, Austin, Tex.

[73] Assignee: Xerox Corporation, Stamford, Conn.

[21] Appl. No.: 728,113

[22] Filed: Oct. 9, 1996

[51] Int. Cl.[6] ..... B41J 2/06

[52] U.S. Cl. ..... 347/55; 347/54

[58] Field of Search ..... 347/55, 141, 114, 347/115, 112; 310/328; 399/291, 317

[56] References Cited

U.S. PATENT DOCUMENTS

| | | | |
|---|---|---|---|
| 3,582,954 | 1/1971 | Skala | 347/55 |
| 4,014,694 | 3/1977 | Schmidlin | 430/67 |
| 4,359,752 | 11/1982 | Nakagawa et al. | 347/55 |
| 4,647,179 | 3/1987 | Schmidlin | 399/285 |
| 4,743,926 | 5/1988 | Schmidlin et al. | 347/55 |
| 4,810,604 | 3/1989 | Schmidlin | 347/55 |
| 4,814,796 | 3/1989 | Schmidlin | 347/55 |
| 4,860,036 | 8/1989 | Schmidlin | 347/55 |
| 4,876,561 | 10/1989 | Schmidlin | 347/55 |
| 4,894,343 | 1/1990 | Tanaka et al. | 435/301 |
| 4,956,619 | 9/1990 | Hornbeck | 359/317 |
| 4,962,723 | 10/1990 | Hotomi | 347/55 |
| 5,066,533 | 11/1991 | America et al. | 347/47 X |
| 5,083,857 | 1/1992 | Hornbeck | 359/291 |
| 5,162,969 | 11/1992 | Leung | 347/55 |
| 5,239,222 | 8/1993 | Higuchi et al. | 310/309 |
| 5,313,451 | 5/1994 | Yagi et al. | 369/126 |
| 5,400,062 | 3/1995 | Salmon | 347/55 |
| 5,418,418 | 5/1995 | Hirano et al. | 310/328 |
| 5,444,191 | 8/1995 | Yamamoto et al. | 178/18 |
| 5,457,493 | 10/1995 | Leddy et al. | 348/164 |
| 5,477,250 | 12/1995 | Larson | 347/55 |
| 5,490,009 | 2/1996 | Venkateswar et al. | 359/291 |
| 5,526,172 | 6/1996 | Kanack | 359/291 |
| 5,767,877 | 6/1998 | Mei et al. | 347/54 |

FOREIGN PATENT DOCUMENTS

| | | | |
|---|---|---|---|
| 41051 | 1/1992 | Japan | 347/54 |
| 4-141459 | 5/1992 | Japan | 347/55 |
| 5-124189 | 5/1993 | Japan | 347/55 |
| 6143660 | 5/1994 | Japan | 347/55 |

OTHER PUBLICATIONS

Patent Abstracts of Japan, vol. 18, No. 317 (M–1622) 16, Jun. 1994 JP–6–71881 (Sony Corp).

Patent Abstracts of Japan, vol. 15, No. 493 (M–1191) 13, Dec. 1991 JP–3–216344 (Seiko Epson Corp).

*Primary Examiner*—Benjamin R. Fuller
*Assistant Examiner*—C. Dickens
*Attorney, Agent, or Firm*—Oliff & Berridge, PLC

[57] ABSTRACT

A toner jet printer and method of use for printing images by manipulating individual toner particles using two-dimensional print cell arrays built by micro electro mechanical systems (MEMS) technologies. Toner particles are positioned by electrostatic forces within each print cell by either selective or non-selective filling. If selectively filled, each cell is then subjected to a mechanical force to eject the toner particles onto a paper substrate. If non-selectively filled, only those print cells corresponding to an intended image are addressed electronically to eject a toner particle from an addressed cell by mechanical forces controlled by micro actuator actuation. Single color or multiple color printing can be achieved using the same cell array.

22 Claims, 6 Drawing Sheets

TWO-DIMENSIONAL PRINT CELL ARRAY APPARATUS AND METHOD FOR DELIVERY OF TONER FOR PRINTING IMAGES

BACKGROUND OF THE INVENTION

A toner jet printer and method of use for printing images by manipulating individual toner particles using two-dimensional print cell arrays built by micro electro mechanical systems (MEMS) technologies. Toner particles are positioned by electrostatic forces within each print cell. Each cell is then addressed electronically to eject one or more toner particles from an addressed cell, by a combination of mechanical and electrical forces controlled by a micro actuator, toward a substrate. As such, a mechanical assist is provided to aid in electrostatic transfer. The printer is capable of high-speed, two-dimensional printing.

There are known direct electrostatic printers, such as U.S. Pat. Nos. 4,743,926, 4,814,796, 4,860,036 and 4,876,561, all to Schmidlin and assigned to the same assignee as the present invention, that eliminate an intermediate transfer drum. There are also known micro electro mechanical systems (MEMS) that have been used as basic electro mechanical structures, such as nozzles, suspension beams, hinges and diaphragms. These include U.S. Pat. Nos. 5,418,418, 5,239,222, 5,313,451, 5,444,191, 5,526,172, 5,083,857, 5,457,493, and 4,956,619. These have proven feasible and sufficiently reliable for use in critical components. Rapid advances of MEMS technologies in recent years have produced commercial products in various application areas. One of these is the ink jet printer. However, until now, such technologies have not been applied to xerographic printing technology.

SUMMARY OF THE INVENTION

The invention relates to a toner jet printer and method of use for printing images by manipulating individual toner particles using two-dimensional print cell arrays. Toner particles are positioned within one or more print cells by either selective or non-selective filling. The particles are attracted to the print cells by electrostatic forces. Then, each cell is electronically addressed to mechanically eject one or more toner particles from the addressed cells, by a combination of mechanical and electrical forces controlled by a micro actuator such as a bimorphic element, towards a substrate surface. Charge applied to the substrate then pulls the ejected toner particles the rest of the way into contact with the substrate. As such, the micro actuator provides a mechanical assist useful in conjunction with electrostatic transfer.

In particular, the invention relates to a toner jet printer for printing on a substrate, comprising: a supply of toner particles, each of a predetermined size; and a two-dimensional cell array of print cells relatively positionable under the supply of toner particles and a substrate for receiving an image, wherein each print cell comprises: a nozzle forming a well on a front side of the cell array sized to receive one or more toner particles from the supply of toner particles; an orifice on a bottom of the well; a micro actuator located below the well, the actuator including a movable actuator element provided adjacent the orifice and sized to substantially fill the orifice forming a movable bottom wall of the nozzle well, said actuator element being movable between retracted and released states; an electrode located below the actuator element; and addressing logic for controlling actuation of said micro actuator between the retracted and released states to control ejection of toner particles from within one or more print cells of the two-dimensional array onto the substrate when the substrate is located opposite the front side of the cell array by release of the actuator element.

Preferably, the micro actuator is a bimorphic element, in either a cantilever or torsion beam configuration. However, a horizontal spring with a latch mechanism can also be utilized. The mechanical force ejects the toner upwards out of the print cell well sufficiently so that the electrostatic charge on the paper can pull the toner the rest of the way. This allows for reduced electrostatic forces necessary and provides better coverage and efficiency. Moreover, if sufficient force is provided by the micro actuator, the ejection can be achieved solely by the micro actuator without electrostatic assist.

BRIEF DESCRIPTION OF THE DRAWINGS

Embodiments of the invention will be described in detail with reference to the following drawings, wherein.

DETAILED DESCRIPTION OF PREFERRED EMBODIMENTS

Figure 1:
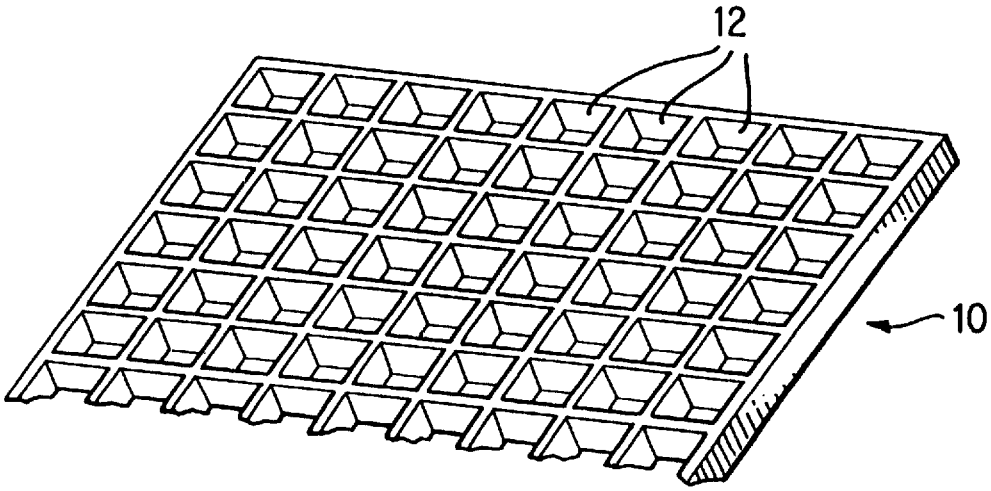
FIG. 1 illustrates a two-dimensional print cell array comprising a plurality of print cells that form a printing plate.
Figure 2:
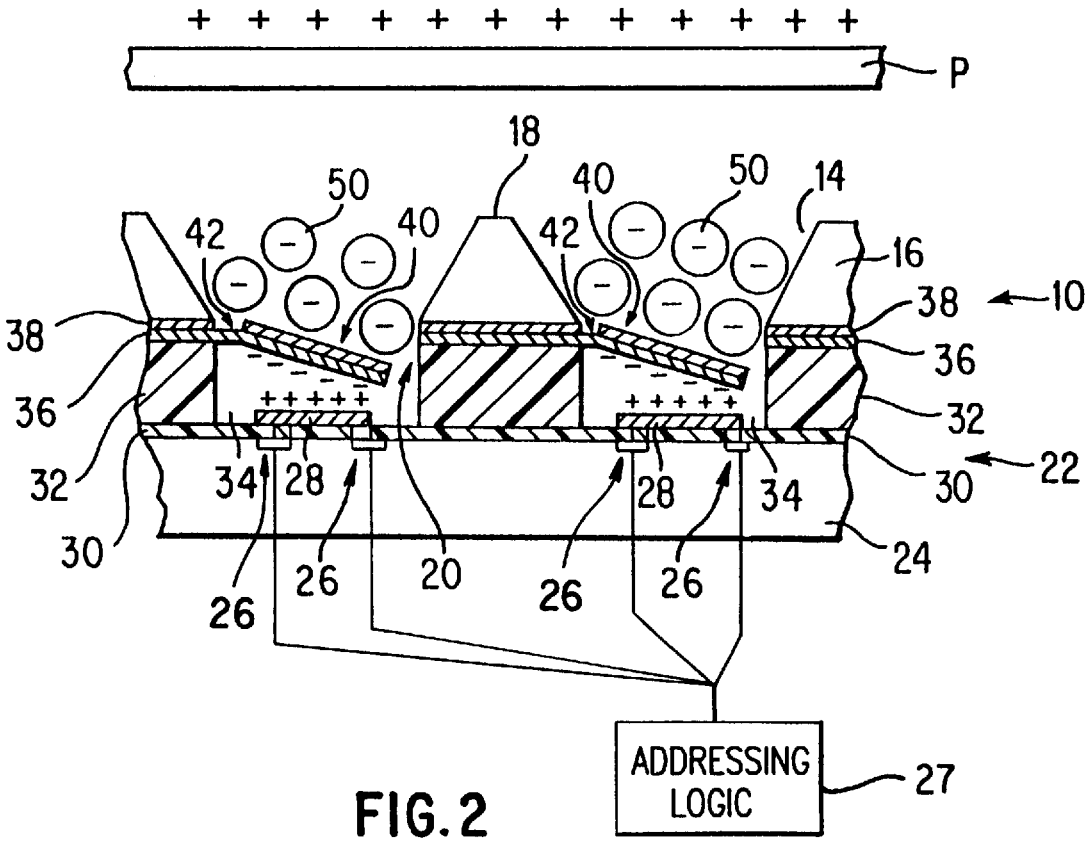
FIG. 2 illustrates a side sectional view of the structure of individual toner jet print cells according to the invention.

A toner jet printer according to the invention includes a two-dimensional array 10 of print cells 12 as shown in FIG. 1. Each print cell 12, as shown in FIG. 2, has a nozzle defining a well 14 formed by bulk micromachining of a print cell substrate 16 made of a material, such as, for example, silicon or glass. A front side 18 of the print cell faces a print direction and substrate (paper) P. The print cell 12 is preferably sized to allow multiple toner particles 5 to be in the cell well 14 to provide sufficient density to a formed image, although the invention can be practiced with as little as one toner particle 50 per cell 12. Preferably, the well 14 is square with the sides having a length of between 10–20 microns, allowing an array of four wells 14 to map into a single pixel of a 300–600 dpi picture image. Using typical toner particles 50 of between 5–7 microns, this allows for about six or so toner particles 50 per well 14.

The bottom of the print cell substrate 16 is formed with a through hole 20. A micro actuator array 22 located immediately below the print cell substrate 16 forms a movable bottom for each print cell well 14. Micro actuator 22 can take the form of several known micro electro mechanical system components, but preferably includes a bimorphic element, such as a cantilever element or a torsion beam element.

In the exemplary cantilever beam actuator shown, actuator 22 comprises a base substrate 24 having discrete addressing circuits 26 and electrodes 28 corresponding to each of the print cells 12. An insulative layer 30 may be provided between the electrodes 28 and base substrate 24. Spacers 32 are provided to define actuator cavities 34 and to space a thin, deformable metal layer 36, formed on top of the spacers 32, from electrodes 28. A relatively thick, mask patterned metal layer 38 is provided on top of thin metal layer 36. A movable cantilever 40 is provided above each cavity 34 serving as the actuator element. This element is preferably sized to correspond with and form a bottom wall of the well 14. Accordingly, if the well 14 has a square bottom, cantilever 40 should have a substantially square shape sized to substantially fill the bottom of the well 14.

Cantilever 40 is formed by selectively eliminating thick metal layer 38 at one or more edge portions 42, leaving only thin layer 36 to act as a cantilever beam. The remaining portion of cantilever 40 remains rigid due to the existence of thick layer 38. The cantilever 40 including thin layer 36 acts as a movable plate of a variable air-gap capacitor.

The length, width, thickness, material and mass of the cantilever 40 can be selectively adjusted to effect a desired deflection amount or rate according to a particular application. Preferably, downward deflection has a slow rate and upward deflection has a faster rate to achieve better filling and ejection characteristics. The deflection rate also can be variably controlled by the electric field generated in the air gap, such as by controlling the waveform used to address the electrodes 12. U.S. Pat. No. 5,418,418, incorporated herein by reference in its entirety, teaches using a sawtooth waveform to allow a slow deformation in one direction and a fast deformation in an opposite direction. The deflection amount needs to be sufficient enough to assist in ejection of the toner particles 50 from the well 14 toward substrate P. This minimum necessary amount will vary depending on the toner particle 50 size and well 14 size used. However, it is believed that about 10° deflection can be obtained using this structure.

Figure 3:
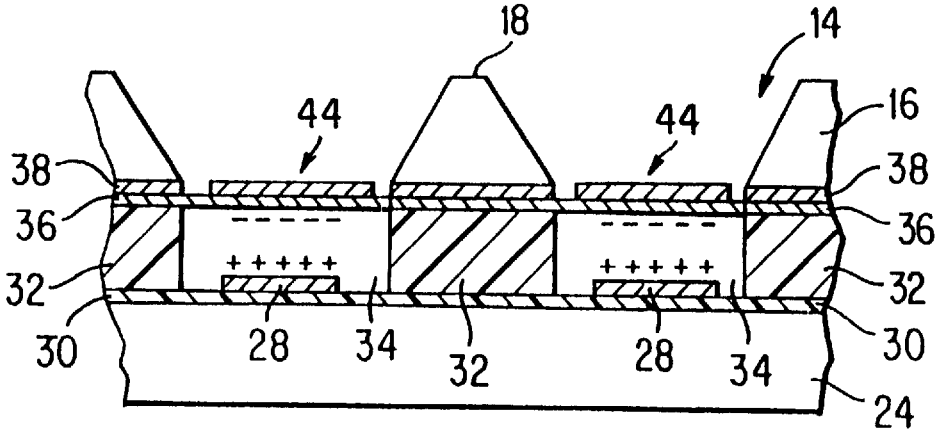
FIG. 3 illustrates a side sectional view of an alternative print cell embodiment.
Figure 4:
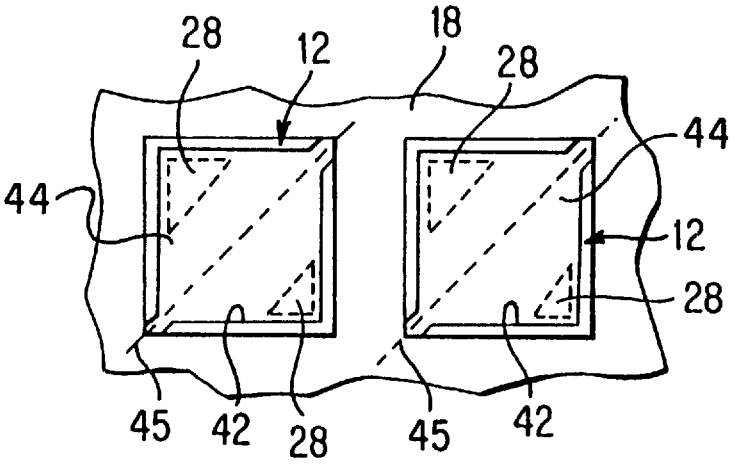
FIG. 4 illustrates a top view of the print cell embodiment of FIG. 3.

Alternatively, as shown in FIGS. 3–4, torsion beam micro actuator elements 44 can be provided. These operate similar to cantilevers 40 and like elements are identified with the same reference numerals; however, these actuators support the element symmetrically about and relative to a rotation axis 45. Here, two oppositely charged electrodes 28 can be provided, one to repel one side of the actuator element 44 upward while the other electrode 28 attracts the other side of the actuator element 44 downward. For a better understanding of how such actuators can be fabricated, one can look at the disclosure of U.S. Pat. Nos. 5,526,172, 4,956,619, 5,490,009 and 5,083,857, incorporated herein by reference in their entirety.

Figure 5:
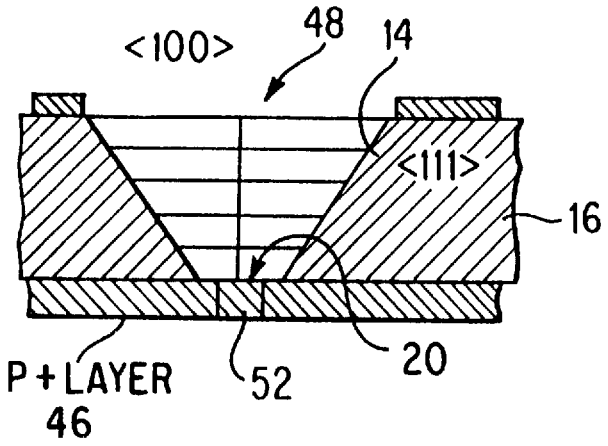
FIG. 5 illustrates a method of fabricating a nozzle and orifice of a print cell.
Figure 6:
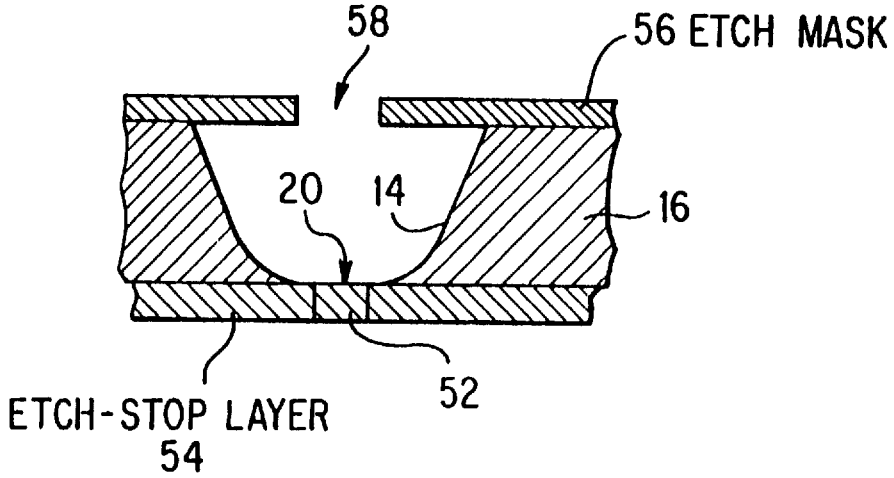
FIG. 6 illustrates another method of fabricating a nozzle and orifice of a print cell.

As shown in FIGS. 5–6, each print cell 12 of the print cell array 10 can be formed by well established bulk micromachining techniques. FIG. 5 shows fabrication of a print cell well 14 housing a print cell substrate 16 made from silicon (Si (100)) wafer. The Si (100) wafer has a thin $P^+$ layer 46 on the back side. An opening 48 is first etched by photolithography. Then, a truncated pyramid well 14 is formed by anisotropic etching that is stopped at $P^+$ layer 46. The $P^+$ layer 46 can be removed to expose through hole 20 formed through the bottom of the substrate 16. Alternatively, the $P^+$ layer 46 can be etched to form an orifice 52 sized to mate with the micro actuator 22.

FIG. 6 shows fabrication of a print cell well 14 having a print cell substrate 16 made from glass. An etch-stop layer (SiN) 54 is deposited on the back side of the print cell substrate 16. An etch mask 56 is formed on the surface of the glass. A concave well 14 is formed by over etching with a proper opening 58 in the etch mask 56. The etch stop layer 54 is removed to provide through hole 20 on the bottom side of the print cell substrate 16. Alternatively, an orifice 52 can be formed by patterning and etching the etch-stop (SiN) 54 to provide a well bottom of a predetermined size to match the micro actuator.

The assembled and machined print cells 12 form a two-dimensional array 10 serving as a printing plate as shown in FIG. 1. Plate 10 can be of any size, although it preferably is sized to print a complete page in a single pass. Accordingly, it should have dimensions at least as large as the printing area of a particular paper size, such as standard 8.5"×11" or A4.

Figure 7:
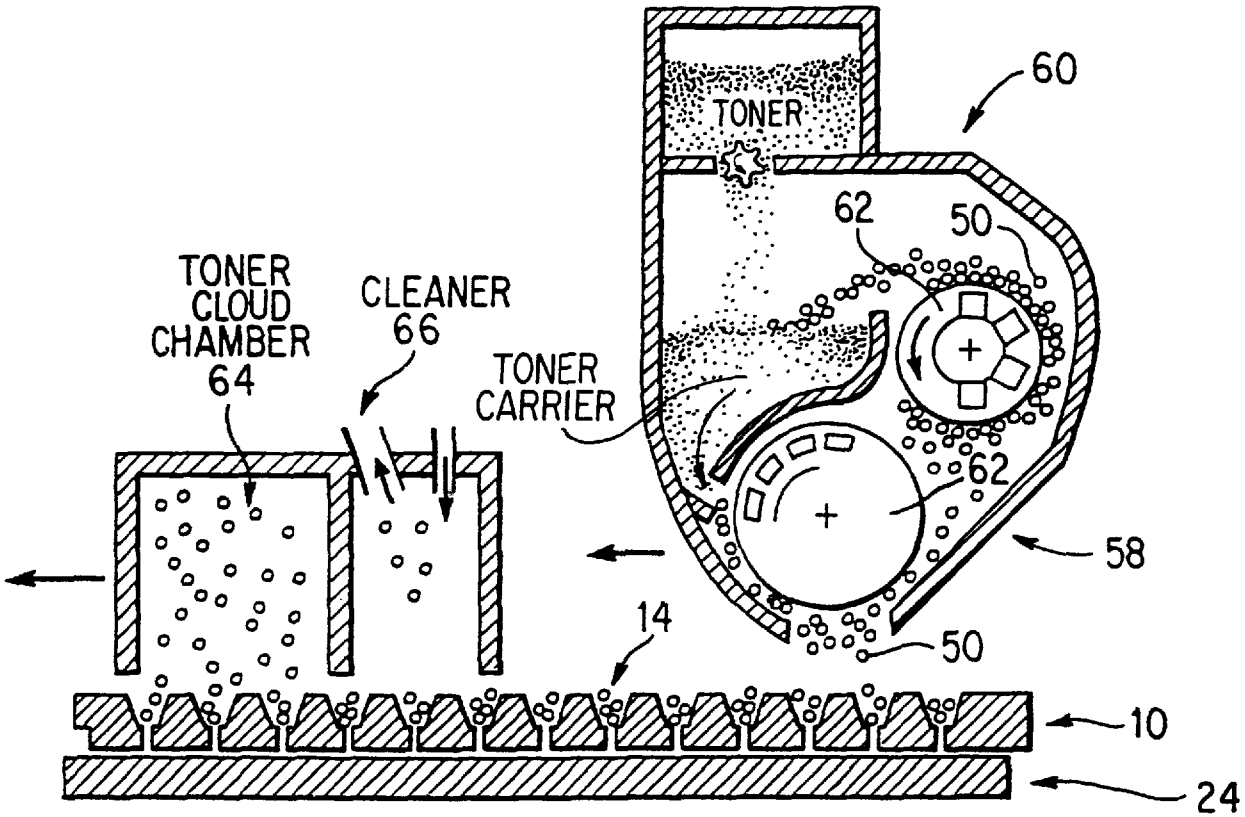
FIG. 7 illustrates exemplary embodiments of filling individual print cells of the printing plate.

Micro actuator arrays 22 can be controlled by transistor switches (active addressing) or by multiplexing row and column signals (passive addressing) forming addressing logic 27 as known in the art. FIG. 7 illustrates various methods of selectively filling or non-selectively filling the print cell array 10 with toner.

Filling is achieved by relatively positioning the printing plate 10 under a supply of toner particles 50, which could simply be a toner hopper 58. In a preferred non-selective fill embodiment, each actuator 22 is retracted and each cell 12 is filled with one or more toner particles 58. Filling is obtained by electrostatic forces acting to drop particles 50 into the wells 14. However, to avoid problems with light and small toner particles 50 sticking on the surface 18 of the print cells 12 by electrostatic forces, a traditional toner-carrier mixer 60 and magnetic brushes 62 may be used to fill the print cells 12 as shown in FIG. 7. When magnetic toner particles are used, residual particles can be cleaned by known xerographic magnetic brushes. Alternatively, toner particle filling and cleaning can be performed by passing a toner cloud chamber 64 with a vacuum cleaner 66 over the cell array 10.

Figure 8:
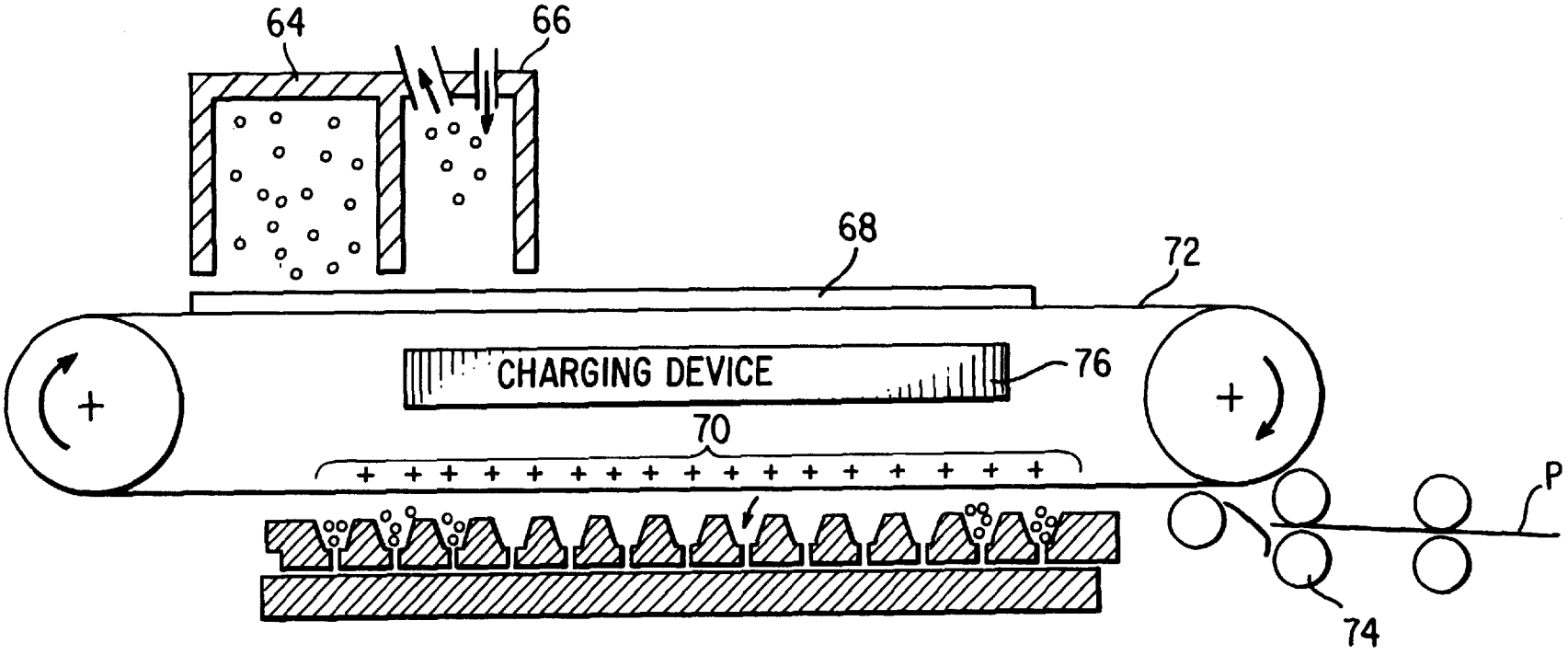
FIG. 8 illustrates an exemplary embodiment of filling and printing using the print cell array according to the invention.

The toner supply can be fixed and the print cell array 10 movable or vice versa. However, for registration, it may be preferable to have the print cell array 10 fixed and the toner supply movable to the print cell array 10. This can be achieved by fixedly mounting the print cell array 10 and mounting the toner supply for movement relative to the array 10 (FIG. 7) or providing an indexing endless transport belt 72 containing the toner supply on one portion 68 thereof and a substrate P transport mechanism 74 provided on another portion 70 (FIG. 8).

In operation, transport belt 72 can advance to place toner portion 68 under toner supply 64. Electrostatic charge applied on the belt 72 retains a predetermined height of toner on the belt. Alternatively, doctoring/metering blades as known in the art can be used to control toner height. Belt 72 is then rotated so that toner portion 68 is adjacent and above print cell array 10.

Activation (addressing) of all print cell micro actuators lowers the movable actuator members due to electrostatic attraction as shown in the lower half of FIG. 2. The electrostatic attraction also aids in attracting and retaining the toner particles 50 from the belt surface 72 in portion 68 into the individual wells 14 of the print cell array 10 by applying voltage to the electrode 28 such that the like-charged movable actuator member 40 and toner particles 50 are drawn toward the electrode 28 also as shown in FIGS. 2 and 8. Then, belt 72 is again rotated and paper P is advanced from transport mechanism 74 onto belt 72 at portion 70.

Meanwhile, prior to receipt of the paper P onto belt 72, belt 72 is charged by charge device 76 with a charge of a predetermined polarity, such as a positive charge. The charged belt having a thus charged paper P thereon is rotated and stopped at a position immediately above the print cell array 10 (FIG. 8).

Figure 9:
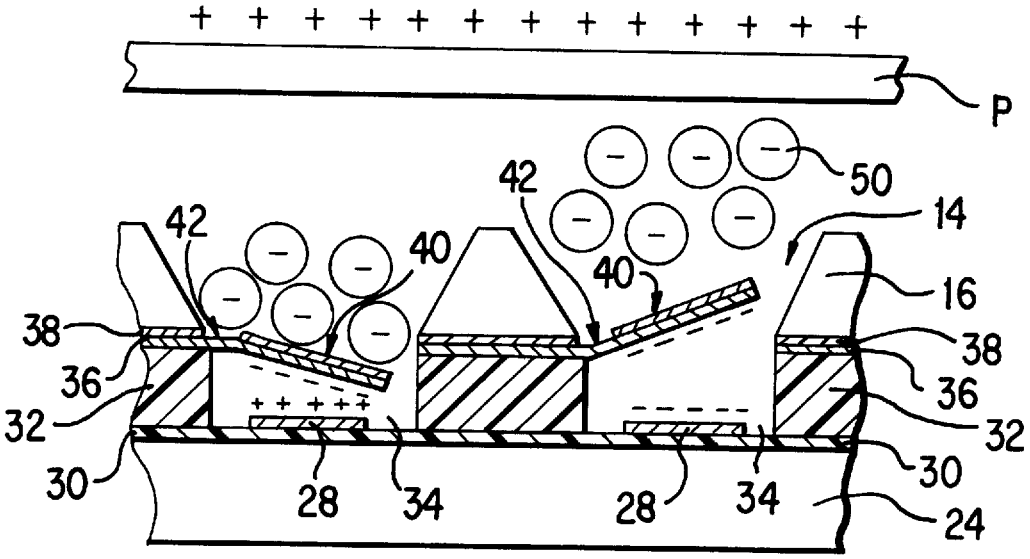
FIG. 9 illustrates an embodiment of printing using the printing plate with selective printing.

Particular print cells 12 corresponding to a desired image to be printed have their corresponding actuators addressed causing release of the retracted actuators and ejection of toner particles 50 from within the prints cell wells 14 toward substrate P as shown in FIG. 4. Release can be achieved by reversal of voltage polarity applied to the electrodes 28 in the bimorphic element embodiments (FIG. 9). An added advantage of the latter is that the electrostatic charge generated by this release is of the same polarity as the toner particles 50 and aids the mechanical ejection of the toner particles 50. After forming the image, a cleaner can remove unwanted particles from the array 10 or the remaining toner particles 50 (non-activated cells) can remain in these cells 10 until subsequent refilling. A downstream fuser can permanently affix the toner to the paper P.

Alternatively, selective filling can be achieved by addressing of print cells 12 corresponding to an image to be printed. This causes retraction of select actuator elements and generation of electrostatic charge in only those print cells 12. Passing of vacuum cleaner 66 or magnetic brushes 62 over the array 10 will remove excess undesired toner, including all toner particles 50 from non-selected cells 12. Then, when paper P is advanced above the array 10, all micro actuators can be addressed and activated to be released. However, as toner particles 50 are only located in selected cells 12, a desired image can still be obtained.

While in any of the preceding embodiments, printing can be achieved in as few as one pass, it may be desirable to use multiple passes to build up a thicker, more dense image. Additionally, while in its simplest form, the inventive toner jet printer prints in one color, more than one color can be used so that the same cell array 10 can provide highlight or full color printing. This can be realized by printing as above in a first color. Then, the array can be cleaned by a cleaner and refilled using a different color toner. This filling, cleaning and printing process can be repeated any number of times to provide full color printing in a plurality of passes using the same cell array.

Alternatively, multiple color printing can be achieved by sequentially filling selected subsets of the print cell array 10 with different colored toner particles and printing in a single pass. In this embodiment, a 2×2 matrix of print cells 12 are designed to map to a single image pixel. Each matrix includes a cell for each of Cyan, Yellow, Magenta and Black (CYMK). In a first pass by a first toner such as cyan, toner can fill the cells 12 and a cleaning operation will remove toner particles 50 from all cells 12 but activated cyan pixel cells. In the activated cells 12, an electrostatic charge is provided and maintained that will retain the actuator in the retracted position and retain the particles 50 in the selected well 14. Thus, a first color has been selectively filled. This process can be repeated for each additional color (YMK). As each cell 12 fills, subsequent passes by other toner colors do not effect them as the cells 12 remain filled by the maintained electrostatic charge. After all colors have been filled, printing can be achieved in a single pass as in the previous embodiments in which selected print cells are activated by reversal of polarity, releasing the micro actuators and ejecting toner from the selected print cells 12.

The invention has been described with reference to preferred embodiments thereof, which are illustrative and not limiting. Various changes may be made without departing from the spirit and scope of the invention as defined in the appended claims.

What is claimed is:

1. A toner jet printer for printing on a substrate, comprising:

a supply of toner particles, each of a predetermined size; and a two-dimensional cell array of print cells relatively positionable under said supply of toner particles and a substrate for receiving an image, wherein each print cell comprises:

a nozzle forming a well on a front side of said cell array sized to receive one or more toner particles from said supply of toner particles;

an orifice on a bottom of said well;

a micro actuator located below said well, said micro actuator including a movable actuator element and a base substrate, said base substrate having discrete addressing circuits and an electrode located and spaced below said movable actuator element, said electrode provides an electrostatic force that causes movement of said movable actuator element between retracted and released states when an energization state of said electrode is changed, said movable actuator element being adjacent said orifice and sized to substantially fill said orifice forming a movable bottom wall of said well; and addressing logic that addresses said discrete addressing circuits to control energization of said electrode and thus controlling movement of said micro actuator between said retracted and released states to control ejection of said one or more toner particles from within one or more print cells of said two-dimensional array onto the substrate when the substrate is located opposite the front side of said cell array by release of said movable actuator element.

2. The toner jet printer of claim 1, wherein all print cells are non-selectively filled with said one or more toner particles and predetermined print cells of said cell array are selectively addressed by said addressing logic so that one or more movable actuator elements are released causing ejection of said one or more toner particles from said predetermined print cells to form a toner image on the substrate.

3. The toner jet printer of claim 1, wherein said two-dimensional cell array is made of micro-machined silicon.

4. The toner jet printer of claim 1, wherein said two-dimensional cell array is made of glass.

5. The toner jet printer according to claim 1, wherein each said nozzle well is sized to allow at least two toner particles to be retained therein.

6. The toner jet printer of claim 1, wherein each said nozzle well is sized to have a diameter of about 10–20 microns.

7. The toner jet printer according to claim 1, wherein each said nozzle well is sized to allow multiple print cells to map into a single image pixel to provide grayscale images.

8. The toner jet printer of claim 1, wherein each said nozzle well is sized to allow about six of said one or more toner particles to be retained in said nozzle well.

9. The toner jet printer of claim 1, wherein said movable actuator element is a bimorphic element.

10. The toner jet printer of claim 9, wherein said movable actuator element is a cantilever beam.

11. The toner jet printer of claim 9, wherein said movable actuator element is a torsion beam.

12. The toner jet printer of claim 1, wherein said electrode and said movable actuator element form an air gap capacitor and generate a first electrostatic charge of a first polarity when said movable actuator element is retracted and generate a second electrostatic charge of a second opposite polarity when said movable actuator element is released.

13. The toner jet printer of claim 12, wherein said toner particles are magnetic and attracted to said movable actuator element by said first electrostatic charge and repelled from said movable actuator element by said second electrostatic charge.

14. The toner jet printer of claim 1, further comprising a charger for charging said substrate with an electrostatic charge that attracts said one or more toner particles ejected from said one or more print cells onto said substrate.

15. The toner jet printer of claim 1, wherein the two-dimensional array is a fullwidth page printer.

16. The toner jet printer of claim 1, further comprising a toner cleaner movably located above said cell array to remove excess toner ones of said particles from said print cell array.

17. A method of direct printing of toner on a substrate using a two-dimensional array of print cells having nozzle wells on a front side of said cell array sized to receive one or more toner particles from a toner supply, a plurality of micro actuators located on a backside of the cell array, one micro actuator provided for each print cell, and addressing logic for controlling a retracted/released state of the micro actuators, the method comprising the steps of:

(a) relatively positioning the front side of the cell array opposite said toner supply;

(b) filling one or more nozzle wells of the cell array with said one or more toner particles while corresponding ones of said micro actuators are in the retracted state;

(c) relatively positioning the front side of the cell array opposite said substrate; and (d) using said addressing logic to address discrete addressing circuits to selectively address one or more of the micro actuators to release the retracted micro actuators causing a mechanical ejection force that ejects said one or more toner particles from said print cells corresponding to the selectively addressed micro actuators toward the substrate.

18. The method of claim 17, wherein the step of filling includes passing a movable toner cloud chamber over the cell array and generating an electrostatic charge in the micro actuators that assists in attraction of the toner particles within the nozzle wells.

19. The method of claim 17, wherein the step of filling includes passing a movable toner-carrier mixer over the cell array and generating an electrostatic charge in the micro actuators that assists in attraction of the toner particles within the nozzle wells.

20. The method of claim 17, further comprising a step of cleaning excessive and unwanted toner particles from the front side of the cell array by passing a movable vacuum cleaner over the front side of the cell array after filling.

21. The method of claim 17, further comprising a step of cleaning excessive and unwanted toner particles from the front side of the cell array by using magnetic toner particles and passing a movable magnetic brush over the front side of the cell array.

22. The method of claim 17, wherein the micro actuators are a bimorphic element, step (b) includes applying a first voltage to an electrode of one or more of the micro actuators to retract the micro actuators and step (d) includes applying a second voltage to the electrode to release said one or more of the micro actuators.

* * * * *